United States Patent [19]

Shepherd et al.

[11] 3,931,440

[45] Jan. 6, 1976

[54] ROOFING SHINGLE UTILIZING AN ASPHALT COMPOSITION AND METHOD OF MAKING AN ASPHALT-SATURATED BASE SHEET

[75] Inventors: Philip Bickford Shepherd, Sedalia; Robert William Croop, Littleton, both of Colo.

[73] Assignee: Johns-Manville Corporation, Denver, Colo.

[22] Filed: Feb. 11, 1974

[21] Appl. No.: 441,524

[52] U.S. Cl. ..... 428/281; 106/282; 428/285; 428/443

[51] Int. Cl.[2] ..... D04H 1/08; B32B 19/04

[58] Field of Search.. 106/282; 117/126 GQ, 140 R, 117/168; 428/281, 285, 443

[56] References Cited

UNITED STATES PATENTS

| | | | |
|---|---|---|---|
| 2,619,675 | 12/1952 | Woolff | 106/282 |
| 2,640,786 | 6/1953 | Parsons et al. | 106/282 |
| 2,733,159 | 1/1956 | Scoggin et al. | 106/282 X |
| 2,771,387 | 11/1956 | Kleist et al. | 117/126 X |
| 2,893,889 | 7/1959 | Schuetz et al. | 117/126 X |
| 3,015,582 | 1/1962 | Simison | 117/126 |
| 3,216,888 | 11/1965 | Cacossa et al. | 106/282 X |
| 3,332,830 | 7/1967 | Tomlinson et al. | 117/126 X |
| 3,808,164 | 4/1974 | Gulino et al. | 106/282 X |

*Primary Examiner*—Michael R. Lusignan
*Attorney, Agent, or Firm*—Robert M. Krone; Stephen C. Shear

[57] ABSTRACT

A method of making a roofing shingle and an asphalt-saturated base sheet generally, utilizing a particular asphalt composition, are disclosed herein. The composition includes asphalt, which at least initially is in a molten state, and a filler material, preferably limestone or other similar mineral filler, dispersed throughout the molten asphalt. In addition, the composition includes a small amount of glass in the form of glass fiber bundles dispersed throughout the asphalt. The glass fiber bundles are made of monofilaments bonded together and are preselected to affect the viscosity of the molten asphalt in a predetermined way depending upon the temperature of the asphalt.

5 Claims, No Drawings

ROOFING SHINGLE UTILIZING AN ASPHALT COMPOSITION AND METHOD OF MAKING AN ASPHALT-SATURATED BASE SHEET

BACKGROUND OF THE INVENTION

1. Field of the Invention

The present invention relates generally to asphalt compositions and more particularly to a roofing shingle utilizing a specific asphalt composition.

2. Description of Prior Art

Most roofing shingles made today are constructed of a base sheet, usually either rag felt or, more recently, glass fiber mat, saturated with a bituminous substance, usually asphalt, including a large amount of filler material such as limestone dust. Roofing shingles of this general type are made in various different sizes and shapes and utilize asphalt compositions and base sheets which differ greatly from one another. In this regard, the various competitors making up the roofing industry are constantly striving to decrease the manufacturing costs of their shingles while, at the same time, striving to improve shingle strength, weatherability and overall general quality. One feature which, in recent years, has been somewhat overlooked is shingle fire-resistance. For the most part, this is because many manufacturers already have a "fire-resistant" asphalt shingle having a "Class A" rating from Underwriters Laboratories, the highest UL rating for fire resistance that can be presently obtained.

In order to keep the cost of asphalt shingles at a competitively low level, most manufacturers use an inexpensive low-viscosity asphalt and relatively inexpensive filler material such as limestone in manufacturing their shingles. To improve upon shingle fire-resistance, many manufacturers have found it necessary to incorporate some type of fire-resistant improving additive to the asphalt-filler combination. One typical additive is asbestos and another is ferric chloride ($FeCl_3$). A major problem in utilizing asbestos is that it is at least thought to be a hazardous material and thereby requires expensive equipment to maintain acceptable air quality standards during manufacture.

A major problem with $FeCl_3$ is that it is a corrosive material and $FeCl_3$ asphalts tend to form troublesome coats and skin during shingle manufacture. However, without any additive, that is, utilizing an asphalt composition including only asphalt of the inexpensive and low-viscosity type typically used and filler material such as limestone, it is difficult to provide a highly fire-resistant shingle without, for example, utilizing an expensive base sheet. The major reason for this resides in the viscosity or flow characteristics of the asphalt used.

More specifically, shingled roofs, unlike built-up roofing decks, lie at a slope with the horizontal. When the shingles are subjected to a fire, the asphalt melts and reaches high temperatures rather rapidly. At these temperatures, without any additive other than the conventional filler, the asphalt has a low viscosity and flows quite rapidly down the roof slope and away from the source of fire. In so doing, it carries much of the filler and base material with it. This, in turn, leaves any hot spots on the support deck exposed to the air and particularly any breeze or wind. By utilizing an additive such as asbestos or $FeCl_3$, the asphalt is sufficiently viscous such that a protective coating or crust is formed over the hot spot acting as a shield against the outside air.

This protective coating or crust results from the burned remains of at least a portion of the combustible ingredients comprising part of the asphalt composition.

PRIOR ART REFERENCES

U.S. Pat. Nos. 2,489,242 (Slayter et al.), 2,771,387 (Kleist et al.), and 3,332,830 (Tomlinson et al.) are being made of record herein because, it is believed, they are of general relevance to the subject matter disclosed herein. However, it is not believed that the subject matter disclosed in these patents is at all pertinent to the present invention. For example, Slayter et al. is directed to a particular method and particular apparatus for making fine glass fibers. As disclosed, these fibers are used as additives in several different types of products such as, for example, innertubes for pneumatic tires. As specifically stated, "It has been found the addition of these very fine fibers to many liquids such as kerosine, resin solutions, etc., is effective to increase the viscosity of the liquids to a great extent even when only a very small percentage of fibers are added. This is due apparently to the extreme fineness and the great surface area of the fibers." (See column 11, lines 17–24.)

The Kleist et al. patent and the Tomlinson et al. patent both disclose asphalt-treated glass fiber structures and methods of producing them. The former patent, in discussing its method, states in column 7, lines 6–11, "It is desirable sometimes to load the material [the bituminous material] with inorganic finely divided or powdered fillers such as glass sandings, clays, slate flour, chalk, micadust, crushed or powdered silica, diatomaceous earth and the like to reduce flow and tackiness of the bituminous impregnating composition and to improve its insulating property." The Tomlinson et al. patent discloses a way of enhancing fire safeness of its asphalt shingle "by incorporating concentrations of chopped strands or bundles of fibers of discrete length at the product edges which are critically exposed when installed on the surface to be protected." (Column 3, lines 60–63.) It should be noted that these chopped strands or bundles of fibers are provided in concentrated areas well after impregnation or saturation of the glass fiber mat which also comprise part of the Tomlinson et al. shingle.

The present invention is entirely different from and unobvious in view of the above-discussed patents, as will be seen hereinafter. Applicants of the present invention have discovered that they can uniformly disperse a very small amount of glass in the form of glass fiber bundles in molten asphalt to control its viscosity in an advantageous way. More specifically, they have found a way to maintain the viscosity of molten asphalt at a sufficiently low level to readily permit saturation of a base sheet while, at the same time, causing the viscosity of the asphalt to increase at elevated temperatures to a level which retards the flow of the asphalt an amount sufficient to permit formation of the aforedescribed protective coating or crust. This can be done without using undesirable additives such as asbestos or $FeCl_3$.

BRIEF SUMMARY OF THE INVENTION

An object of the present invention is to provide a fire-resistant asphalt roofing shingle.

Another object of the present invention is to provide a viscosity-controlled asphalt composition for saturating a base sheet.

Still another object of the present invention is to provide a method of making a fire-resistant asphalt-saturated base sheet.

These objects, as well as other objects and features to become apparent hereinafter, are achieved by the utilization of a particular asphalt composition made in accordance with the present invention. This composition is comprised of molten asphalt, which is maintained at a relatively low saturating or coating temperature, preferably between approximately 350°F and 450°F, and a mineral filler material, such as limestone, dispersed throughout the molten asphalt.

In accordance with the present invention, glass fiber bundles of a preselected type, each bundle comprising a plurality of monofilaments bonded together, are also dispersed throughout the molten asphalt. These glass fiber bundles are selected to meet a number of requirements. For example, with the bundles dispersed throughout the molten asphalt and with the asphalt being maintained at a relatively low temperature, for example between 350°F and 450°F, i.e., the asphalt-saturating or coating temperature, the monofilaments of each bundle should substantially remain bonded together (unless, of course, the asphalt is severely agitated) and the viscosity of the molten composition must remain at a sufficiently low level for saturating or coating the base sheet.

After saturation of the base sheet, let it be assumed that the saturated base sheet is positioned on a sloped deck and subjected to a source of fire, reaching a temperature of, for example, 700°F. Under these conditions, the monofilaments of each bundle should separate and disperse throughout the asphalt and the viscosity of the composition, specifically the asphalt, should increase from the saturating level to a level which retards the flow of the asphalt. More specifically, the flow of the asphalt should be retarded an amount sufficient to prevent at least some of the combustible material, for example some of the base sheet and some of the mineral filler, from flowing away from the source of fire. In this manner, that portion of the base sheet and filler material will burn, the residue or ash forming a coating or crust at the source of fire and preventing the outside air from reaching any hot spots.

By selecting the glass fiber bundles preferably to meet the aforediscussed requirements, the molten asphalt composition is sufficiently flowable to readily saturate or coat the base sheet in producing roofing shingles and yet, when subjected to flame temperatures, is sufficiently viscous to produce the aforestated protective crust or coating.

DETAILED DESCRIPTION AND PREFERRED EMBODIMENTS

The present application is directed generally to asphalt roof coverings and more particularly to an asphalt roofing shingle with improved fireresistance. The asphalt shingle, which may be of any suitable size or shape, includes a base or support sheet encased in and saturated by an asphalt composition, commonly referred to as a filled asphalt coating. The asphalt saturated base sheet is preferably coated at least on its top surface with mineral (ceramic coated) granules or other suitable particulate matter.

As will be seen hereinafter, the asphalt composition includes as its major constituents asphalt and a mineral filler such as limestone dust. In accordance with the present invention, the composition includes a very small amount of glass, in the form of glass fiber bundles, dispersed throughout the asphaltfiller mixture. In fact, in accordance with a preferred embodiment of the present invention, the asphalt composition preferably consists essentially of these three ingredients, i.e., the asphalt, mineral filler and small percentage of glass fiber bundles.

The base sheet utilized as part of the asphalt shingle of the present invention may be any one of many which are presently being used for this purpose. It may, for example, be of the rag felt type or, as more recently provided, the base sheet may take the form of a glass fiber mat. In any event, the base sheet could be made by conventional means in a conventional way and would include the appropriate physical characteristics necessary in manufacturing the shingle and in providing the ultimately manufactured shingle with its own appropriate physical characteristics. One with ordinary skill in the art could reasonably provide such a base sheet.

The asphalt utilized in the asphalt composition of the present invention may also be one which is presently being used by the industry. An asphalt of this type typically has a softening point (R & B) of between, for example, 190°F and 240°F and a penetration at 77°F between, for example, 14dmm and 25dmm. In saturating the aforedescribed base sheet, the asphalt is maintained in a molten state, preferably at a temperature anywhere between 350°F and 450°F. At this temperature and without any fillers or additives, the molten asphalt has a viscosity in Saybolt Furol seconds of between 100 and 300.

The physical properties of the asphalt, as recited herein, are for exemplary purposes only. Any asphalt which functions in the manner to be described hereinafter may be utilized and, in fact, may be readily provided by those skilled in the art. In this regard, the saturating or coating temperature of the molten asphalt, or the operating temperature as it is commonly called, will depend in part on the particular asphalt used and in part on the other ingredients in the overall composition. In any event, the temperature of the asphalt should be sufficiently high to readily saturate or coat the base sheet with the asphalt composition and yet it should not be maintained at a temperature higher than necessary. This is, of course, because a large amount of energy is required to maintain the composition in its molten state.

The asphalt composition of the present invention preferably includes between approximately 40% and 50% asphalt by weight of the total composition. When less than approximately 40% is provided, the asphalt does not satisfactorily fulfill its intended purpose, that is, it does not satisfactorily provide the ultimately produced shingle with adequate physical characteristics. In addition, it tends to be too viscous at the preferred saturating temperatures. On the other hand, providing the composition with more than 50% asphalt is not necessary and, taking into account cost considerations, is not preferable. In this regard, to "extend" the asphalt a suitable conventional filler such as, for example, limestone dust or other mineral filler, is added thereto.

The mineral filler is dispersed throughout the asphalt by conventional means, for example mechanical agitation, when the asphalt is in its molten state, preferably at its saturating temperature. Between approximately 45% and 55% mineral filler, by weight of the total asphalt composition, is preferably utilized. The exact percentage of mineral filler provided will be dictated by the amount of asphalt and the amount of glass in the form of glass fiber bundles which are utilized in the composition, especially when these are the only ingredients comprising the composition. Of course, the filler must not be of a type or an amount which will prevent saturation of the base sheet at reasonable saturating temperatures.

As stated above, in accordance with the present invention, a small percentage of glass in the form of glass fiber bundles is added to the asphaltfiller mixture. These glass fiber bundles are dispersed throughout this mixture or could be dispersed throughout the asphalt prior to the addition of the filler but, in any case, are added while the asphalt is in a molten state, preferably at its saturating temperature. In this regard, the glass may be dispersed in the asphalt by, for example, mechanical agitation. However, the degree of agitation must be sufficiently low to prevent the fiber bundles from separating in any substantial degree into individual monofilaments. The main reason for adding the glass fiber bundles is to substantially improve fire-resistance of the ultimately produced shingle without using conventional additives such as previously discussed asbestos and $FeCl_3$. The glass fiber bundles are of a preselected type which, when added to the molten asphalt-filler mixture, cause the overall asphalt composition to function in a predetermined manner, which will be discussed directly below.

As stated previously, the asphalt-filler mixture when maintained at the aforedescribed saturating temperature, for example, between 350°F and 450°F, will have a sufficiently low viscosity so as to permit easy saturation of the base sheet. While the addition of the glass fiber bundles to this mixture will increase the viscosity slightly, the amount and type of bundles selected must be such that the overall composition, at the saturating temperature, has a sufficiently low viscosity level to permit easy saturation of the base sheet.

While the addition of the glass fiber bundles must not appreciably affect the viscosity of the molten asphalt at the saturating temperature of the asphalt, it must be of the type and amount which will substantially increase the viscosity of the overall composition, actually of the asphalt itself, when the composition is subjected to extremely high temperatures, for example, temperatures above 700°F.

Let it be assumed, for example, that a shingle or, for that matter, an asphalt-saturated base sheet, utilizing the asphalt composition of the present invention, is mounted on a sloped deck at, for example, 5 inches per foot inclination to the horizontal. Let it further be assumed that the shingle or saturated base sheet generally is subjected on its top surface to a source of fire such that the asphalt composition reaches a temperature of, for example, at least 700°F. Under these circumstances, the viscosity of the composition, as a result of adding the fiber bundles, will increase from its low level at the saturating temperature to a level which retards the flow of the asphalt. The viscosity will increase an amount sufficient to permit formation of a fixed coating or crust of the aforedescribed type over the roof deck adjacent the source of fire. Stating this in the negative, the asphalt will not be sufficiently flowable so as to carry away rapidly the base sheet, filler material, granules and added glass fiber from the source of fire. Rather, the asphalt will be sufficiently viscous so as to hold these other components of the shingle at the source of fire long enough to burn and form a crust or coating of the burned remains at the source of fire.

This is accomplished by selecting glass fiber bundles of the type which, when dispersed throughout the asphalt, will defilamentize, that is, separate into individual monofilaments and disperse throughout the asphalt when the latter reaches these high temperatures. It has been found that this defilamentization of the fiber bundles and resulting dispersion of the monofilaments cause the viscosity of the asphalt to increase to the level desired. In this regard, it should be noted that, since defilamentization does substantially increase the viscosity of the asphalt, the glass fiber bundles must be of a type which will not defilamentize to any appreciable degree at the saturating temperature of the asphalt, i.e., at for example, temperatures below 450°F. In addition, severe mechanical agitation of the asphalt for initially dispersing the fiber bundles should be avoided. If the fiber bundles did, in fact, defilamentize to a large extent at these lower temperatures, the asphalt composition would be too viscous to saturate the base sheet.

The exact amount of glass fiber additive utilized in the asphalt-filler mixture will depend in large part on the particular type and amount of glass fibers used as well as the particular type and amount of asphalt and filler. However, it is believed that as little as 0.1% or 0.2% and as much as 3% glass fiber additive, by weight of the total asphalt composition, may be satisfactory. Below approximately 0.1% there more than likely is not sufficient glass in the asphalt to substantially increase the viscosity of the asphalt (at the higher temperatures) to the degree required to accomplish the foregoing results, even though it may be completely defilamentized and dispersed. By the same token, when more than approximately 3% glass additive is provided, the asphalt composition may be too viscous at the saturating temperatures to saturate the base sheet and, since 3% or approximately 3% will usually accomplish the desired results, there is no economical reason to include more. In any event, one with ordinary skill in the art, in view of the teachings in the present disclosure, could readily determine the amount of glass to be added for achieving the desired results.

The exact type of glass fiber which could be used may vary and could also be readily determined by those skilled in the art in view of the teachings of the present invention. However, those which have been found to be acceptable are between approximately ⅛ inch and ½ inch in length, including between 100 and 800 filaments per bundle and having a filament diameter of, for example, 13 to 18 $\mu$. The binder utilized in holding the monofilaments together must, of course, be one which will continue to hold the bundles together, to at least a substantial degree, at the saturating temperature of the asphalt, even though the asphalt is mildly agitated to disperse the glass bundles. It must also be one which, by melting, dissolving or in any other such way, allows the fiber bundles to defilamentize to a large extent at substantially higher asphalt temperatures, for example, at temperatures in excess of 700°F. A suitable and actually preferable binder is polyvinyl acetate. However, other binders may be selected and in view of the teachings set forth herein, they could be readily selected by those skilled in the art.

Obviously, the degree of defilamentization will depend upon the type and amount of glass fiber additive utilized. It is only required that there must be sufficient defilamentization to achieve the aforedescribed desired results.

What we claim is:

1. An asphalt shingle comprising:

a. a base sheet; and b. an asphalt composition substantially completely encapsulating and at least partially penetrating in said base sheet, said composition including i. asphalt, ii. a filler material dispersed throughout said asphalt, and iii. glass fiber bundles of preselected type dispersed throughout said asphalt, said bundles each comprising a plurality of monofilaments and bonding substance for maintaining said monofilaments bonded together, said composition comprising between approximately 0.1% and 3% glass fiber bundles by weight of said composition, c. said bonding substance being such that i. when said composition is maintained at between approximately 350°F and 450°F, said substance maintains substantially all of said monofilaments in each of said bundles bonded together, and ii. when said composition reaches a temperature of approximately 700°F, said substance becomes ineffective to maintain said monofilaments bonded together, whereby said monofilaments separate and disperse throughout said asphalt.

2. A shingle according to claim 1 wherein said glass fiber bundles are selected such that a. with said composition being maintained at between approximately 350°F and 450°F, substantially all of the monofilaments of each bundle remain bonded together and the viscosity of said composition is at a sufficiently low level for saturating said base sheet, and b. after saturation of said base sheet, in the event that said composition is subjected to a source of fire and reaches a temperature of 700°F, the monofilaments of each bundle separate and disperse throughout the asphalt and the viscosity of said composition increases from said low level to a level which retards the flow of said asphalt an amount sufficient to permit formation of a fixed coating comprised of at least partially burned remains of said base sheet, filler material and monofilaments even through said saturated base sheet, when subjected to said source of fire, is positioned so as to define a plane at a slope of approximately 5 inches per foot with the horizontal.

3. A shingle according to claim 1 wherein said composition includes between approximately 40% to 50% asphalt and 45% to 55% filler material by weight of said composition.

4. A shingle according to claim 1 wherein each of said fiber bundles includes between approximately 100 and 800 monofilaments, the monofilaments being between ⅛ and ½ inch long and between approximately 13$\mu$ and 18$\mu$ in diameter.

5. A shingle according to claim 1 wherein said base sheet is comprised of a fiber glass bonded mat.

* * * * *